US005830076A

United States Patent [19]

Borys

[11] Patent Number: 5,830,076

[45] Date of Patent: Nov. 3, 1998

[54] GOLF PRACTICE TARGET APPARATUS

[76] Inventor: James S. Borys, 14194 Carvell, Livonia, Mich. 48154

[21] Appl. No.: 850,070

[22] Filed: May 2, 1997

[51] Int. Cl.[6] ..... A63B 69/36

[52] U.S. Cl. ..... 473/173; 473/162; 473/172; 473/196

[58] Field of Search ..... 473/172, 173, 473/195, 196, 162; 273/181 A

[56] References Cited

U.S. PATENT DOCUMENTS

| | | | |
|---|---|---|---|
| 1,863,756 | 6/1932 | Lufkin . | |
| 1,870,536 | 8/1932 | Vaccaro, Jr. . | |
| 2,677,546 | 5/1954 | Campbell | 473/172 |
| 2,788,792 | 4/1957 | Koller . | |
| 2,806,670 | 8/1957 | Straster . | |
| 3,234,903 | 2/1966 | Vara, Sr. . | |
| 3,490,769 | 1/1970 | Trobett . | |
| 3,856,301 | 12/1974 | Davidson . | |
| 4,171,134 | 10/1979 | Reck . | |
| 4,407,505 | 10/1983 | Kendziorski . | |
| 4,711,260 | 12/1987 | Weins et al. . | |
| 5,179,907 | 1/1993 | Galbraith . | |
| 5,441,267 | 8/1995 | Alder . | |
| 5,486,002 | 1/1996 | Witler et al. . | |

FOREIGN PATENT DOCUMENTS

| | | | |
|---|---|---|---|
| 785654 | 5/1968 | Canada | 273/181 A |
| 172385 | 12/1921 | United Kingdom | 273/181 A |

*Primary Examiner*—Mark S. Graham

[57] ABSTRACT

A golf practice apparatus includes a foldable target in a carrying case that is sized to receive the folded target for transportation. The target has a base portion with the flagpole extending from the base portion. A plurality of arms are foldably connected to the base portion at a plurality of points. A flexible target area extends between the arms to form a surface onto which golf balls may be hit. The case has a main compartment sized to receive the folded target. A handle is coupled to the case to assist in transporting the case. A number of secondary compartments including a stake compartment and a ball compartment may be used to carry stakes and balls with a case. The case may also a number of club brackets for securing golf clubs to the outside of the case.

25 Claims, 4 Drawing Sheets

GOLF PRACTICE TARGET APPARATUS

BACKGROUND OF THE INVENTION

The present invention relates generally to a practice apparatus for the game of golf, and more particularly to a foldable and portable golf target onto which a golfer may hit balls for practice.

The game of golf has continued to increase in popularity. It is beneficial for golfers to practice various shots to improve their performance. A particular need for many golfers is the need to improve the "short" game. The "short" game generally refers to shots that are less than 25 yards from the hole. Generally, "short" shots include shots with a pitching wedge, sand wedge or nine iron.

Several devices are disclosed in the prior art that may act as a target to practice such shots. One such target is described in U.S. Pat. No. 5,441,267. The '267 patent discloses a portable golf stand that has legs extending from a base. The legs detach from the base. The legs support a flagpole. The device disclosed in the '267 patent is believed to be cumbersome to put together since each of the legs disassemble from the base. Because they are capable of being completely disassembled, the legs may be also susceptible to loss. The target described in the '267 patent also is believed to be susceptible to tipping over in a wind.

It is desirable for many golfers to practice the effects of different wind speeds and directions on golf shots including short shots.

It would therefore be desirable to provide a lightweight portable golf target that is not susceptible to being tipped during wind.

SUMMARY OF THE INVENTION

It is one object of the invention to provide a portable golf target that is easy to set up and transport.

In accordance with one aspect of the invention a golf practice apparatus includes a foldable target and a carrying case that is sized to receive the foldable target for transportation. The target has a base portion with a flagpole extending from the base portion. A plurality of arms are foldably connected to the base portion at a plurality of joints. A flexible fabric extends between the arms to form the surface of the target area. The case has a housing with a first compartment that is sized to receive the folded target. A handle is coupled to the housing to facilitate transportation of the target and case.

In one aspect of the invention the foldable target has a stake used to secure the arm to the ground.

In another aspect of the invention, each of the plurality of arms may have an eyelet on the end thereof. The eyelets are sized to receive a stake to further secure the target to the ground. This feature is advantageous when practicing shots into the wind.

The case may have a clips on the housing for mounting a golf club thereto. The case may also have separate compartments for carrying the stakes, for carrying practice balls and for carrying tees.

One feature of the present invention is that the target and case assembly are both manufactured out of lightweight plastic material. The lightweight plastic material is weather resistant and relatively inexpensive to manufacture.

Another feature of the present invention is that the target area may be made of a durable nylon material. The nylon material may be multi-colored to make the appearance of the target device more attractive. Nylon material may be also embossed with a corporate logo for advertising.

One advantage of the present invention is that the arms fold up and remain connected to the base which prevents loss of the legs. This feature also allows easy set up of the target.

BRIEF DESCRIPTION OF THE DRAWINGS

Other features and advantages of the present invention will become apparent from the following detailed description which should be read in conjunction with the drawings in which.

DETAILED DESCRIPTION OF THE PREFERRED EMBODIMENT

Figure 1:
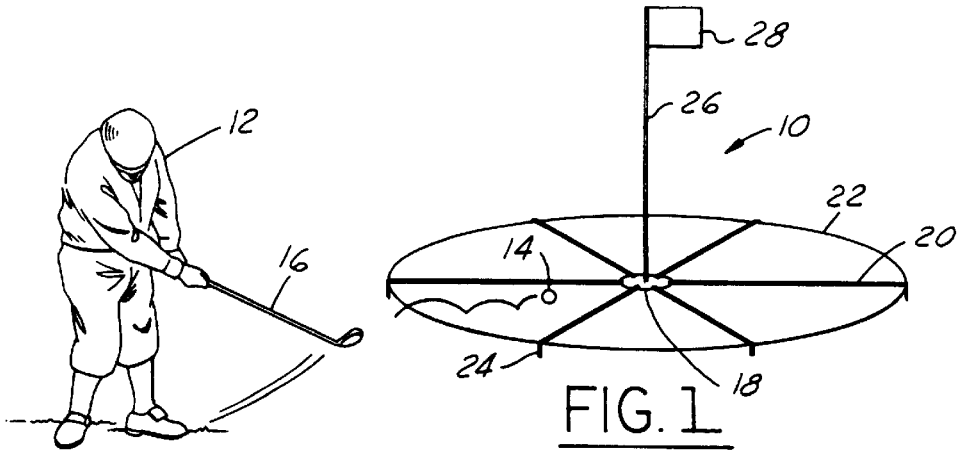
FIG. 1 is a perspective view of a golfer relative to a foldable target according to the present invention.

Referring now to the drawings, like reference numerals are used to identify identical components in the various views.

Referring now to FIG. 1, a perspective view of a target 10 is shown with respect to a golfer 12. Target 10 is designed for a golfer 12 to practice shooting golf balls 14 onto the target surface using a golf club 16. A variety of shots may be practiced including chip shots, shots with various lies and, by moving around the target, shots having different relations with respect to the wind.

Target 10 generally comprises a base 18 having arms 20 generally extending radially therefrom. Between arms 20 extends a pliant target area 22 onto which ball 14 may be shot. Target area 22 provides a surface so that the ball position may be easily seen when golfer 12 is a distance away. Arms 20 and thus target 10 may be secured to the ground by stakes 24.

Base 18 has a flagpole 26 extending therefrom. Flagpole 26 has a flag 28 mounted thereto. Flagpole 26 and flag 28 give golfer 12 a location at which to aim.

Figure 2:
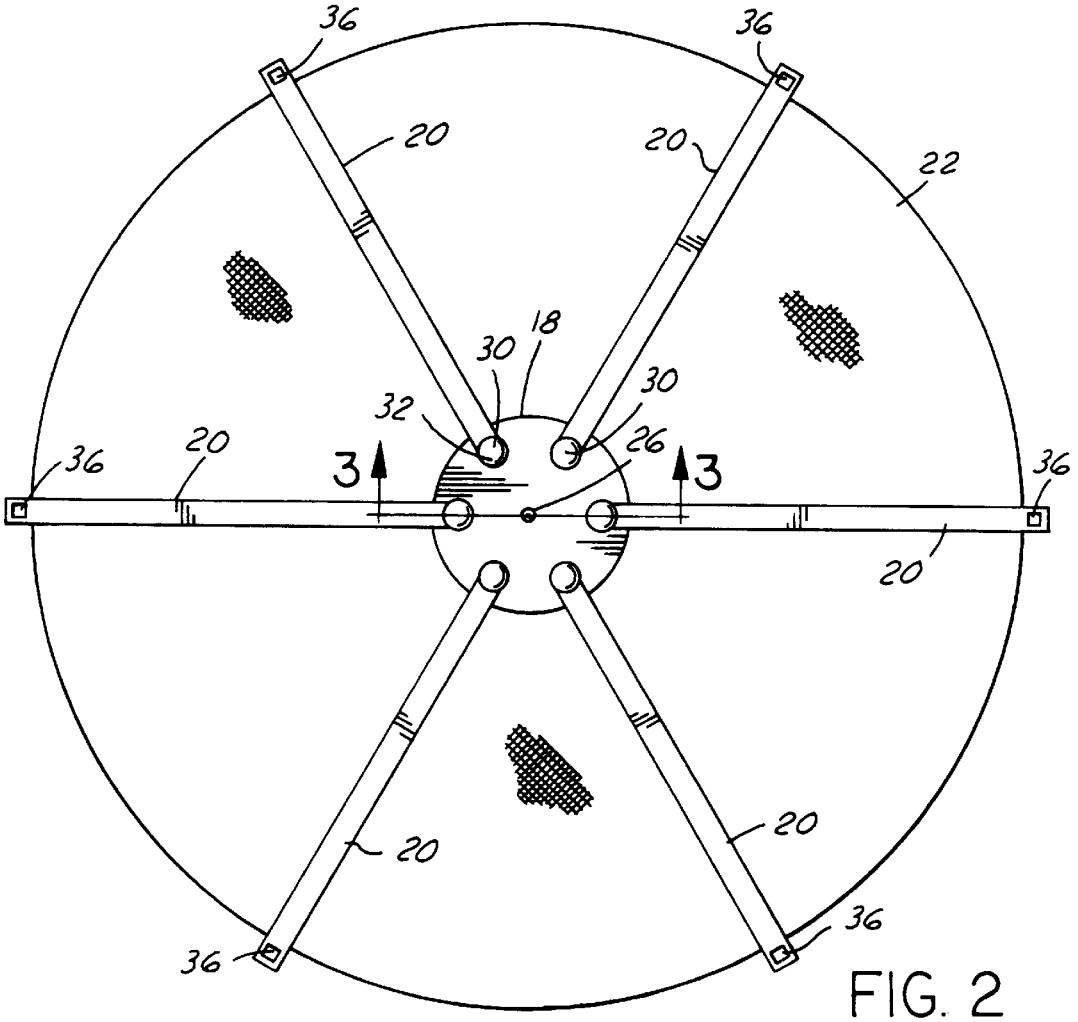
FIG. 2 is a top view of a foldable target according to the present invention.

Referring now to FIG. 2, arms 20 are movably joined to base 18 at a joint 30. Joint 30 may, for example, be a ball and socket type joint. In this manner, arms 20 remain attached to base 18. Using a ball and socket type joint, ball 32 is located on one end of an arm while a socket 34 formed in base 18. Joint 30 allows arms 20 to be folded so that target 20 is easily and conveniently foldable.

The end of arms 20 opposite that of base 18 preferably have an eyelet 36 formed therein. Eyelet 36 is used to locate a stake therethrough for securing target 10 to the ground.

It is preferred that arms 20, base 18 and flagpole 26 are formed of a plastic material. Plastic material provides the benefits of being weather resistant, durable and lightweight. Of course, other materials may be suitable for use in the golf target.

Target area 22 is preferably formed of a resilient and pliant fabric-type material. For example, the fabric-type material may be nylon. Nylon has a desirable characteristic of being weather resistant, durable and lightweight. Target area 22 may be formed of a multi-colored piece of fabric. Target area 22 may easily be customized with corporate logos or other logos.

Figure 3:
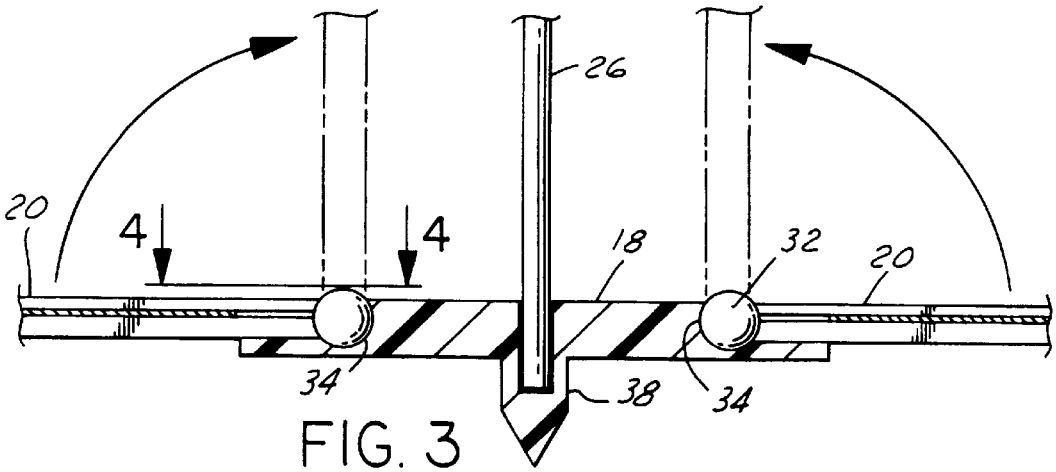
FIG. 3 is a cross-sectional view of a foldable target having arms in the unfolded position.

Referring now to FIG. 3, base 18 may have a center stake 38 that helps secure target 10 to the ground. Arms 20 are shown in their unfolded position in FIG. 3. Socket 34 holds ball 32 and thus arm 20 so that arms 20 fold with respect to base 18.

Figure 3A:
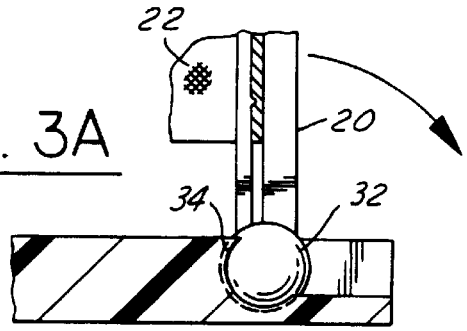
FIG. 3A is a partial cross-sectional view of a foldable target having arms in the folded position.

Referring now to FIG. 3A, an arm 20 is shown in its folded position with respect to base 18. Each of the other arms fold in a similar manner.

As shown in FIGS. 3 and 3A, base 18 is formed of a solid piece of plastic material having the sockets formed therein as well as a mount for flagpole 26. However, base 18 may be formed of two thin plastic coverings having sockets placed between the two coverings. Of course, other alternative configurations of base would be evident to those skilled in the art.

Figure 4:
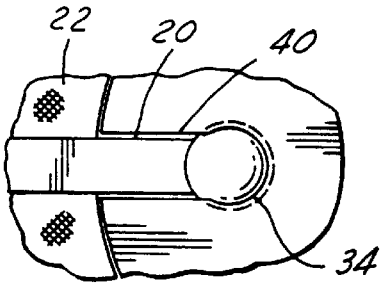
FIG. 4 is a partial top view of the arm joint of a foldable target.

Referring now to FIG. 4, an opening 40 is formed in base 18 to guide arm 20 is folded and unfolded. Opening 40 is preferably sized just wider than the width of arm 20.

Figure 5:
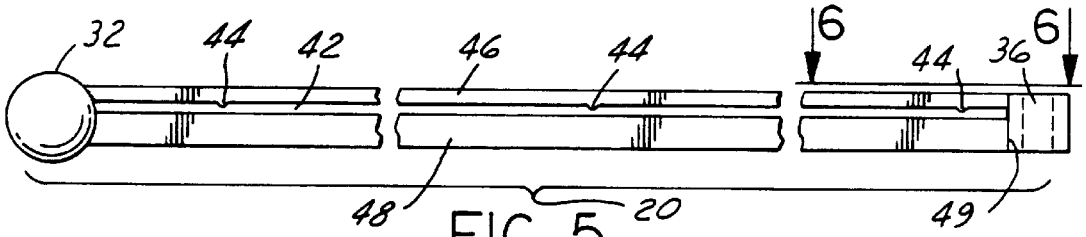
FIG. 5 is a broken elevational view of an arm.

Referring now to FIG. 5, one method for mounting target area 22 to an arm 20 is shown. A slot 42 into which the target area 22 may be secured. Slot 42 divides arm 20 into an upper arm 46 and a lower arm 48.

To facilitate holding target area 22 in place, retainers 44 may be used to grip target area 22. Retainers 44 may be integrally formed into upper arm 46 or may be separate fasteners like screws or rivets that extend between upper arm 46 and lower arm 48.

Figure 6:
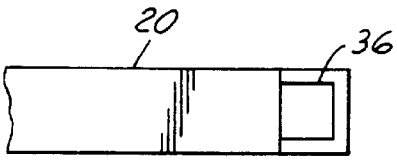
FIG. 6 is an enlarged portion of an end of an arm having an eyelet.

Referring now to FIG. 6, an eyelet 36 is shown in the end of arm 20. Eyelet 36 may be integrally molded with arm 20. Eyelet 36 may also be a separately formed piece later connected to arm 22. A separate eyelet piece 49 may be used to hold upper arm 46 and lower arm 48 together after target area 22 is inserted into slot 42. Eyelet 36 is shown as a rectangular shape that extends through arm 20. Other shapes such as circular may be desirable.

Figure 7:
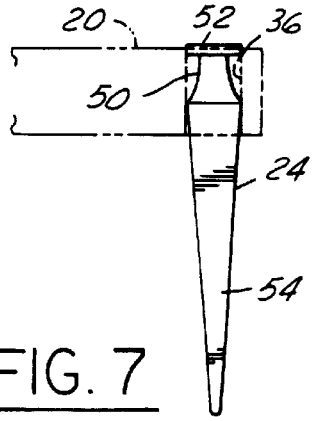
FIG. 7 is a side view of a stake that is to be received within the eyelet of FIG. 6.

Referring now to FIG. 7, a stake 24 is shown with respect to an arm 20 (in phantom lines). Stake 24 may have a reduced diameter portion 50 just below top flange 52 to assist in the removal of stake 24 from the ground. A person may grip stake 24 at the reduced diameter portion and pull up on flange 52. Flange 52 may also be used to pound stake 24 into the ground. Stake 24 has a tapered portion 54 that preferably ends in a point to assist in placing stake 24 into the ground.

Figure 8:
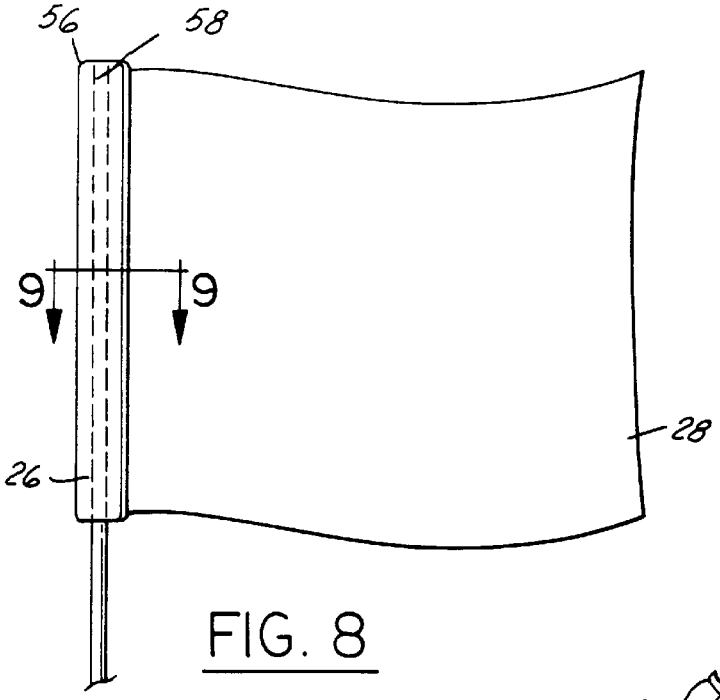
FIG. 8 is a partial side view of a pole with a flag coupled thereto.
Figure 9:
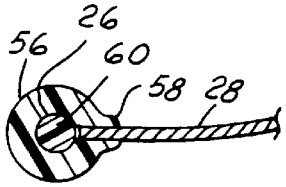
FIG. 9 cross sectional view through line 9—9 of FIG. 8.

Referring now to FIGS. 8 and 9, the configuration for mounting flag 28 to flagpole 26 is shown. Flagpole 26 has a sleeve 56 coupled thereto. Sleeve 56 has a slot 58 running in a vertical direction. Flag 28 is attached to an insert 60. Insert 60 is preferably mounted through the top of sleeve 56 so that flag 28 extends through slot 58. Under normal circumstances flag 28 will be held secured to flagpole 26. However, if additional means for holding flag 28 is required, a cap or other securing means (not shown) may be incorporated into sleeve to prevent the removal of flag 28.

Figure 10:
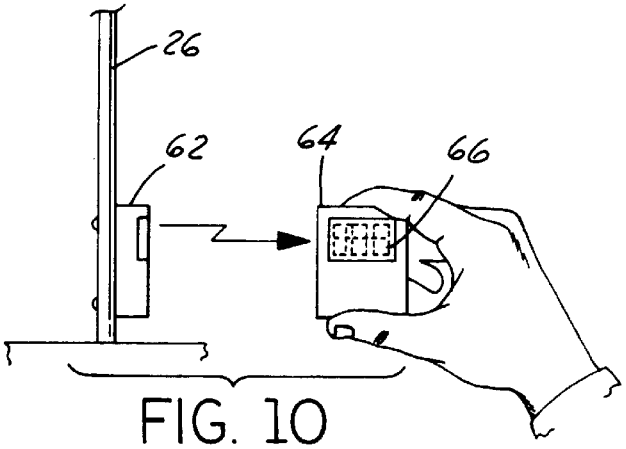
FIG. 10 is a partial perspective view of a flagpole having a distance measuring device coupled thereto, with respect to a hand held distance display.

Referring now to FIG. 10, in many circumstances it would be desirable to know the distance between the golfer and flagpole 26. A transmitter 62 may be mounted to flagpole 26. A hand held receiver 64 having a digital display 66 may read the signal generated by transmitter 62 and convert that signal into a measurement of the distance to the flagpole 26. Both transmitter 62 and receiver 64 are preferably battery operated. Several different ways to measure the distance between transmitter 62 and receiver 64 may be evident to those skilled in the art. Such methods include using an infrared signal or RF signal. Receiver 64 may have a button (not shown) that initiates transmitter 62 to return a signal so that a distance may be measured.

Figure 11:
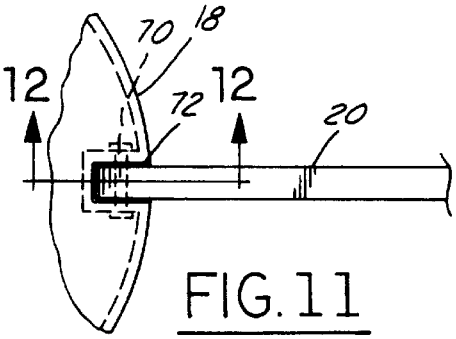
FIG. 11 is a top view of an alternate method for mounting an arm to the base.
Figure 12:
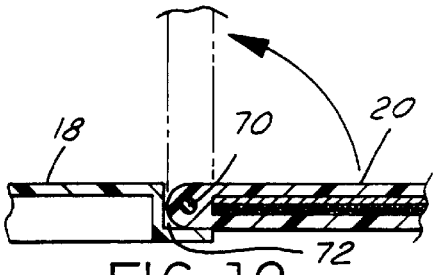
FIG. 12 is a partial cross-sectional view of an alternate method for mounting an arm to the base.

Referring now to FIG. 11, a top view of an alternative method for mounting arm 20 to base 18 is shown. A pin 70 extends through arm 20 to pivotally couple arm 22 to base 18. Arm 20 pivots about pin 70. A rectangular slot 72 is used to secure pin 70.

Figure 13:
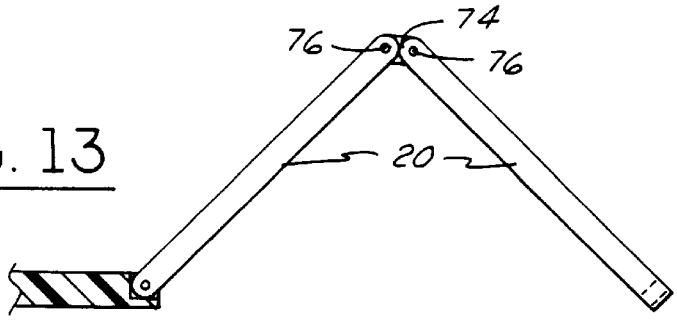
FIG. 13 is a side view of a target having foldable arms.

Referring now to FIG. 13, to facilitate portability, arms 20 may have a center joint 74 which allows arm 20 to fold in half. This allows target 10 to be more compact. One or more pins 76 may be used to pivotally couple two portions of arm 20.

Figure 14:
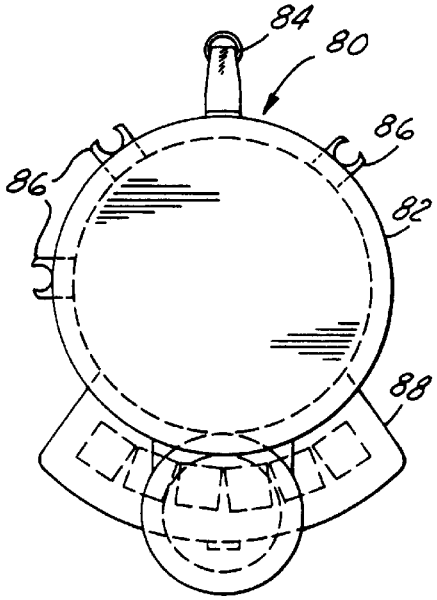
FIG. 14 is an end view of a case for holding the foldable target.

Referring now to FIG. 14, an end view of a case for transporting target 10 and its associated hardware is shown. Case 80 has a housing 81 with a main compartment 82 used for storing target 10 when folded. A handle 84 is coupled to main compartment 82 for easy grasping during transportation. Main compartment 82 may also have club brackets 86 spaced therearound for connecting a golf club thereto.

Main compartment may have a number of secondary compartments coupled thereto for various purposes. For example, a stake compartment 88 may be used to hold the stakes of FIG. 7. A ball compartment 90 may also be coupled to main compartment 82. Ball compartment 90 may have a place for storing tees as well. Ball compartment 90 may be subdivided into a tee compartment 91.

All of the components of case 80 are preferably formed of a resilient plastic material. A plastic material is desired due to its strength, durability and relative light weight. Each of the compartments 82, 88, 90 and 91 preferably have end caps 92 to enclose case 80. In this manner, a golf practice apparatus is achieved that includes a target 10 that is easily folded and stood within the case 80.

Figure 15:
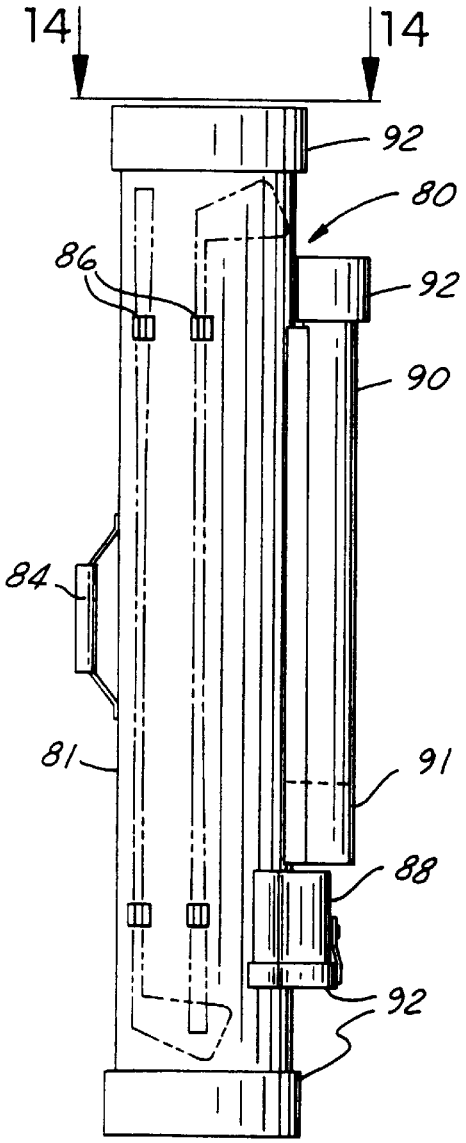
FIG. 15 is a side view of a case for holding a foldable target.

Referring now to FIG. 15, a side view of a case 80 is shown. Preferably, two club brackets 86 are mounted to housing for each golf club to be carried around by case 80.

While the best mode for carrying out the present invention has been described in detail, those familiar with the art to which this invention relates, will recognize various alternative designs and embodiments for practicing the invention as defined by the following claims;

What is claimed is:

1. A golf practice apparatus comprising:

a foldable target having, a base;

a flagpole extending from said base;

a plurality of arms extending radially from said base, said arms being foldable with respect to said base; and a target area extending between the arms, a case having, a housing with a first compartment sized to receive said foldable target;

a handle secured to said first compartment.

2. A golf practice apparatus as recited in claim 1, wherein said arms have a first member and a second member, said target secured between said first member and said second member.

3. A golf practice apparatus as recited in claim 1, wherein said arms are coupled to said base by a joint.

4. A golf practice apparatus as recited in claim 3, wherein said joint is a ball and socket type joint.

5. A golf practice apparatus as recited in claim 4, wherein each of said arms have a ball and said base portion has a plurality of sockets corresponding to a respective ball.

6. A golf practice apparatus as recited in claim 1, wherein said base has a center stake extending therefrom.

7. A golf practice apparatus as recited in claim 1, wherein said base has a plurality of openings, each opening corresponding to one of said plurality of arms.

8. A golf practice apparatus as recited in claim 1, wherein said flagpole has a distance measuring device coupled thereto for measuring the distance between a predetermined object and said distance measuring device.

9. A golf practice apparatus as recited in claim 1, wherein said flagpole has a flag coupled thereto.

10. A golf practice apparatus as recited in claim 9, wherein said flag has a plastic insert coupled thereto; said flagpole having a coupled thereto sleeve for receiving said insert.

11. A golf practice apparatus as recited in claim 1, further comprising a plurality of stakes.

12. A golf practice apparatus as recited in claim 11, wherein each of said arms has an eyelet sized to receive one of said plurality of stakes.

13. A golf practice apparatus as recited in claim 12, wherein said housing further comprises a third compartment sized to receive said plurality of stakes.

14. A golf practice apparatus as recited in claim 1, wherein said housing further comprises a second compartment coupled to the first compartment to receive golf balls.

15. A golf practice apparatus as recited in claim 1, further comprising a clip coupled to said housing for receiving a golf club.

16. A golf practice apparatus as recited in claim 1, further comprising a fourth compartment for receiving tees.

17. A target comprising:

a base;

a flagpole extending from said base portion;

a flag coupled to said flagpole;

a plurality of arms extending substantially radially from said base;

a plurality joints joining each of said arms to said base; and a target portion coupled to and extending between said arms, said arms having a eyelet sized to receive a stake.

18. A target as recited in claim 17, wherein said arms have a first member and a second member, said target secured between said first member and said second member.

19. A target as recited in claim 17, wherein said joint is a ball and socket type joint.

20. A target as recited in claim 19, wherein each of said arms have a ball and said base portion has a plurality of sockets corresponding to a respective ball.

21. A target as recited in claim 17, wherein said base has a center stake extending therefrom.

22. A target as recited in claim 17, wherein said base has a plurality of openings, each opening corresponding to one of said plurality of arms.

23. A target as recited in claim 17, wherein said flagpole has a distance measuring device coupled thereto for measuring the distance between a predetermined object and said distance measuring device.

24. A target as recited in claim 17, wherein said flag has a plastic insert coupled thereto; said flagpole having a sleeve coupled thereto for receiving said insert.

25. A target as recited in claim 17, wherein said arms each is foldable along the length of said arm.

* * * * *